US005430239A

United States Patent [19]

Chen

[11] Patent Number: 5,430,239

[45] Date of Patent: Jul. 4, 1995

[54] MUSIC BOX

[76] Inventor: Joseph Chen, P.O. Box 82-144, Taipei, Taiwan

[21] Appl. No.: 304,123

[22] Filed: Sep. 12, 1994

[51] Int. Cl.[6] ..... G10F 1/06

[52] U.S. Cl. ..... 84/95.2; D17/24; 446/298

[58] Field of Search ..... 84/94.1, 94.2, 95.1, 84/95.2; 446/236, 280, 281, 282, 297, 298; D17/24

[56] References Cited

U.S. PATENT DOCUMENTS 2,840,949 7/1958 Faulkner ..... 84/95.2 X
5,070,753 12/1991 Hou ..... 84/95.2
5,331,110 7/1994 Chen ..... 84/95.2
5,342,988 8/1994 Hsu et al. ..... 84/95.1

*Primary Examiner*—Michael L. Gellner
*Assistant Examiner*—Patrick J. Stanzione
*Attorney, Agent, or Firm*—Alfred Lei

[57] ABSTRACT

A music box mainly comprises a base, a seat, a frame, an arm, a fixing member, a first gear, a supporter, a second gear, a third gear, a first axle, a second axle, a third axle, a rack, a lever, a disc, a screw, a first doll, a second doll, and a third doll, whereby the first doll will be able to sway backwards and forwards, the second doll to rotate, and the third doll to move backwards and forwards.

1 Claim, 5 Drawing Sheets

MUSIC BOX

BACKGROUND OF THE INVENTION

It has been found that the conventional music box is simply a box with a mechanical device that produces a tune when the box is opened. However, such a music box is monotonous and too complicated in structure thereby increasing the cost thereof.

Therefore, it is an object of the present invention to provide a music box which may obviate and mitigate the above-mentioned drawbacks.

SUMMARY OF THE INVENTION

This invention relates to an improved music box.

It is the primary object of the present invention to provide a music box which can cause a first doll to sway backwards and forwards, a second doll to rotate, and a third doll to move backwards and forwards.

It is another object of the present invention to provide a music box which is simple in construction.

It is still another object of the present invention to provide a music box which is compact in size.

It is still another object of the present invention to provide a music box which is economic to produce.

It is a further object of the present invention to provide a music box which is amusing and interesting.

The other objects and merits and a fuller understanding of the present invention will be obtained by those having ordinary skill in the art when the following detailed description is read in conjunction with the accompanying drawings wherein like numerals refer to like or similar part.

DETAILED DESCRIPTION OF THE PREFERRED EMBODIMENT

Figure 1:
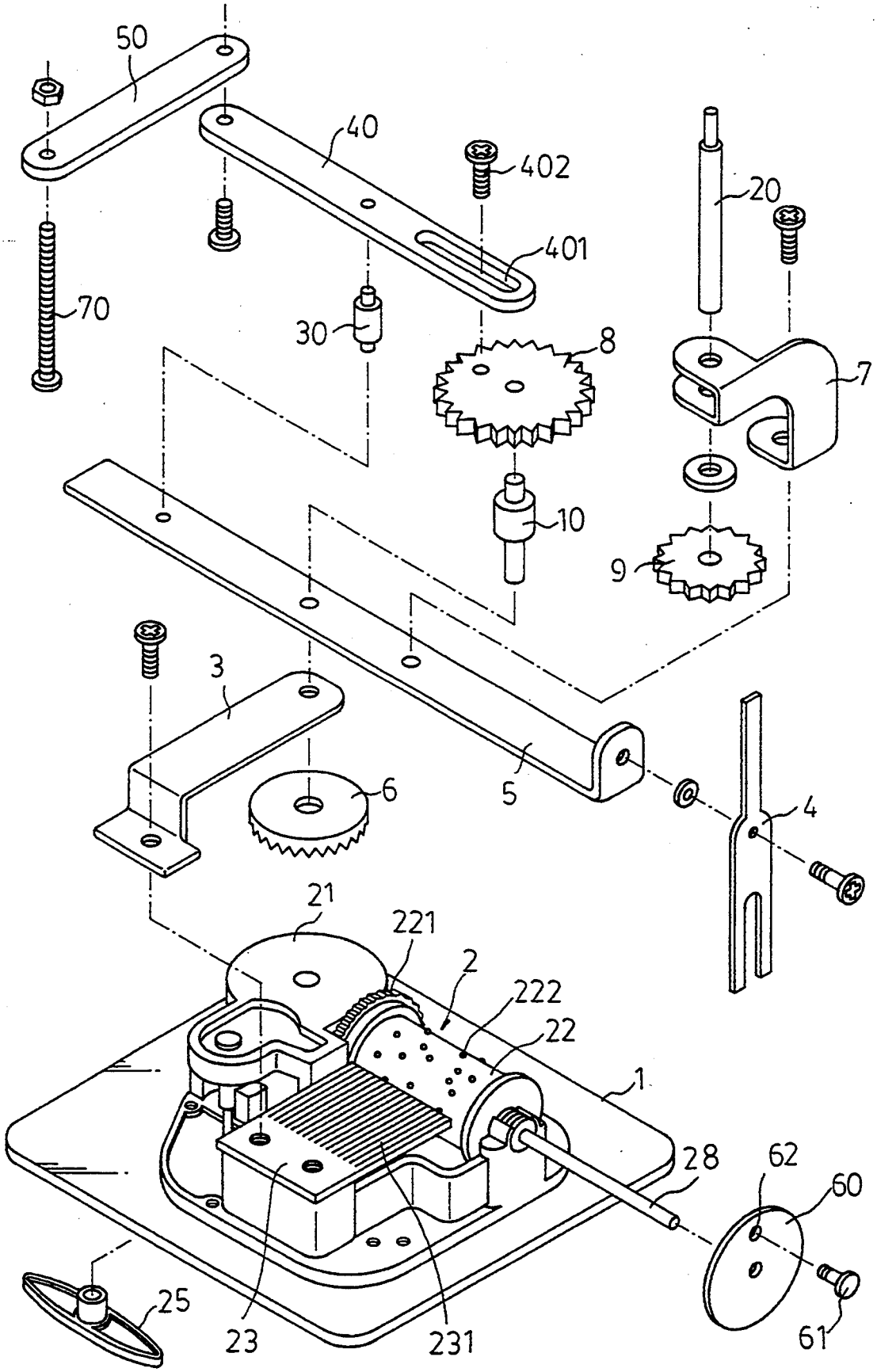
FIG. 1 is an exploded view of the present invention.

For the purpose of promoting an understanding of the principles of the invention, reference will now be made to embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
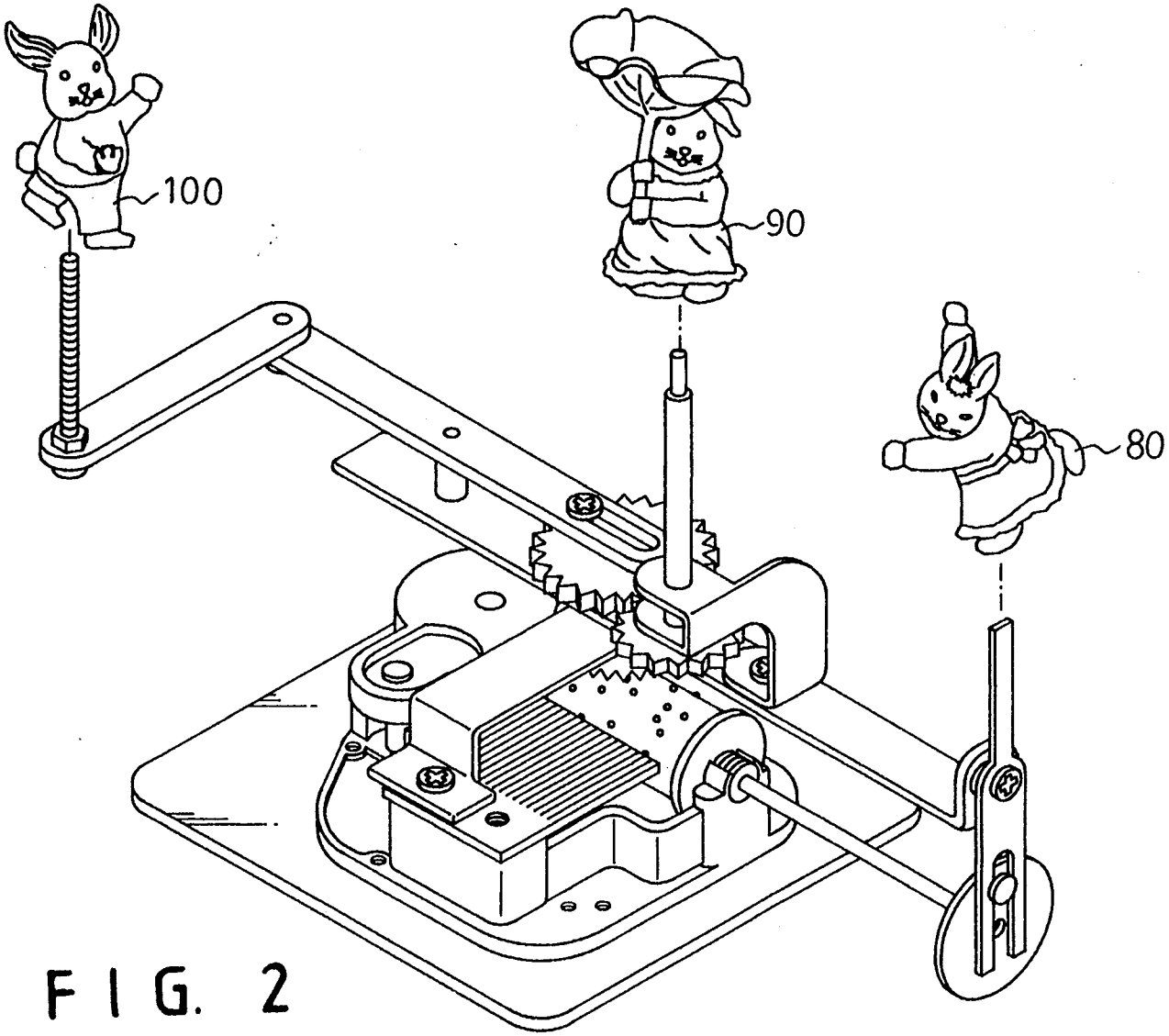
FIG. 2 is a perspective view of the present invention.
Figure 3:
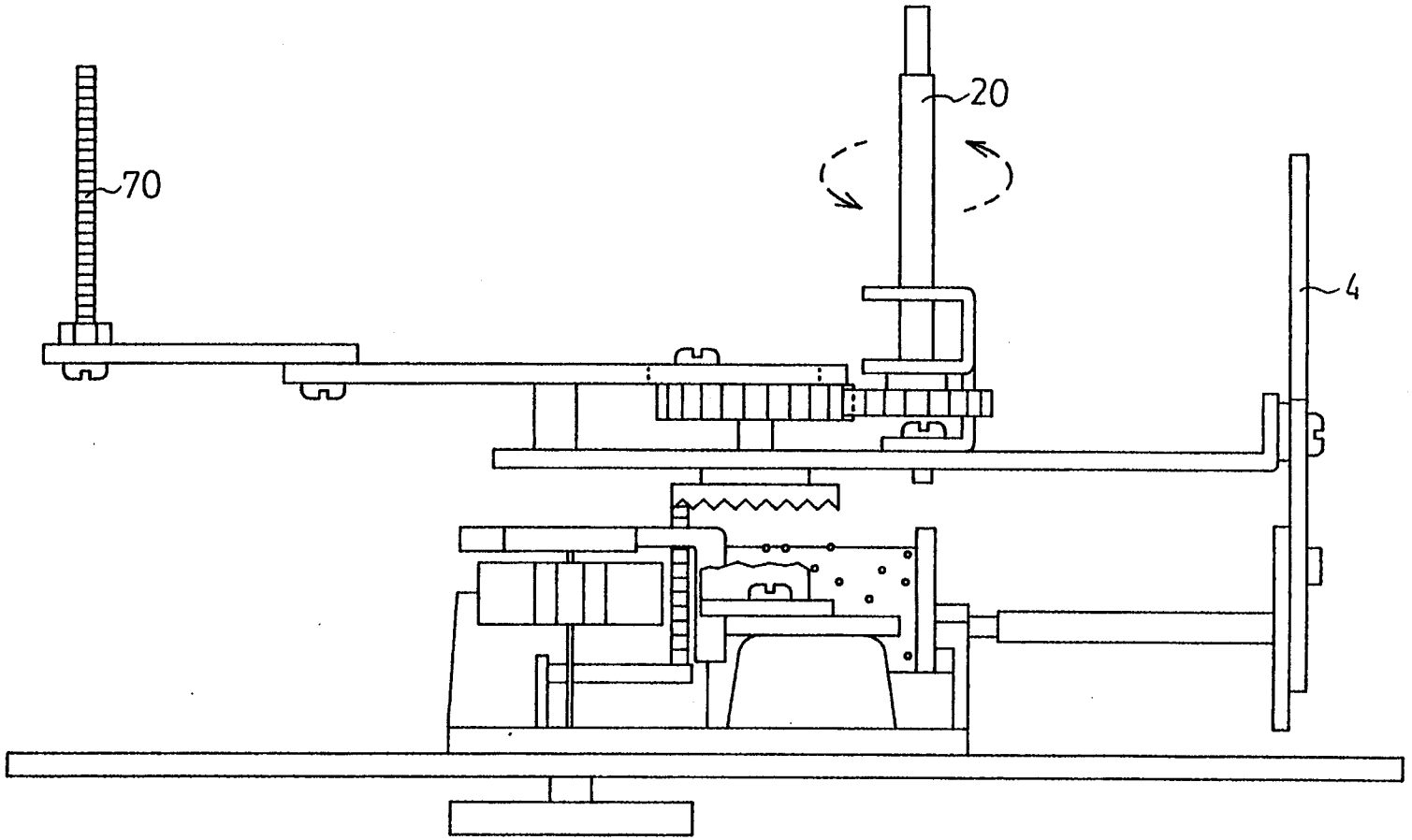
FIG. 3 shows the interior structure of the present invention.
Figure 7:
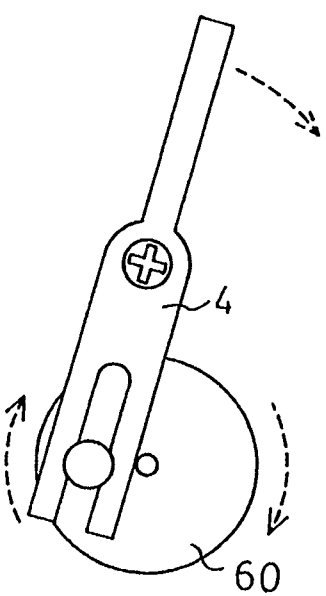
FIGS. 4, 5, 6 and 7 show the way how the first doll is swayed backwards and forwards.
Figure 6:
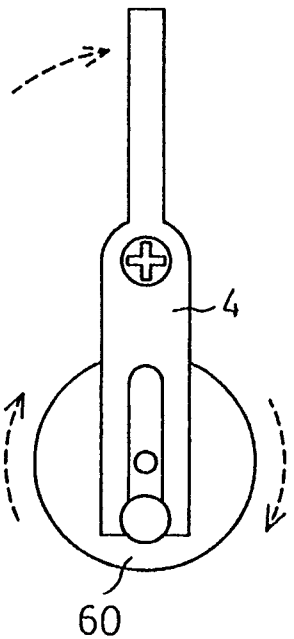
Figure 5:
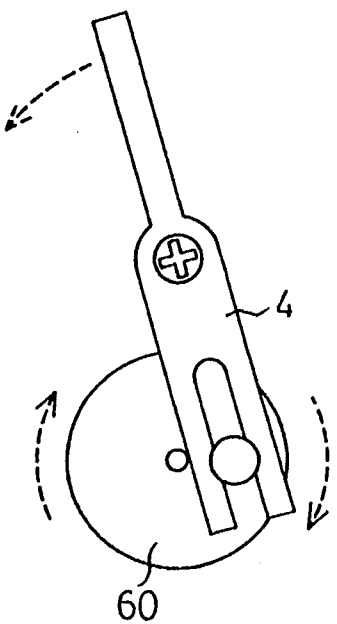
Figure 4:
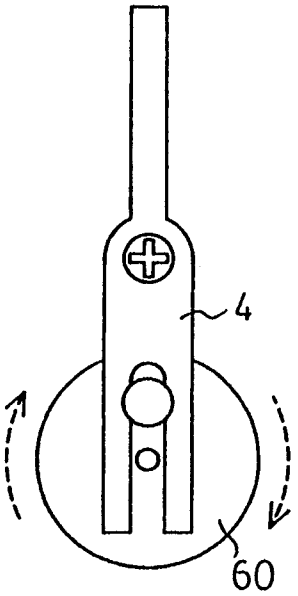
Figure 8:
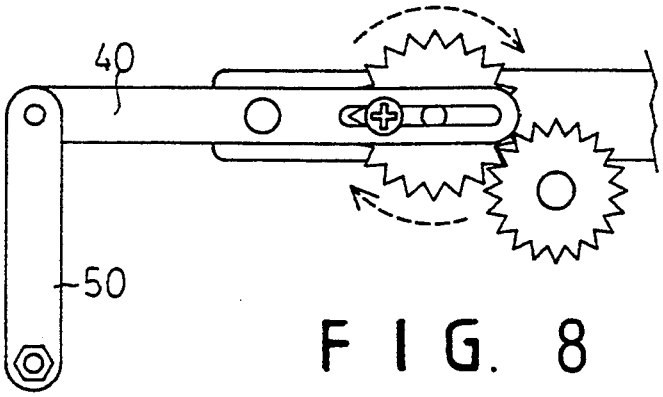
FIG. 8, 9, 10 and 11 show the way how the third doll is moved backwards and forwards.
Figure 9:
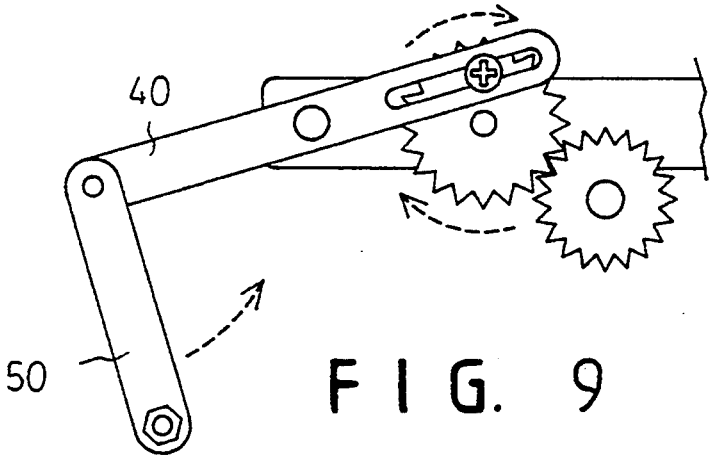
Figure 10:
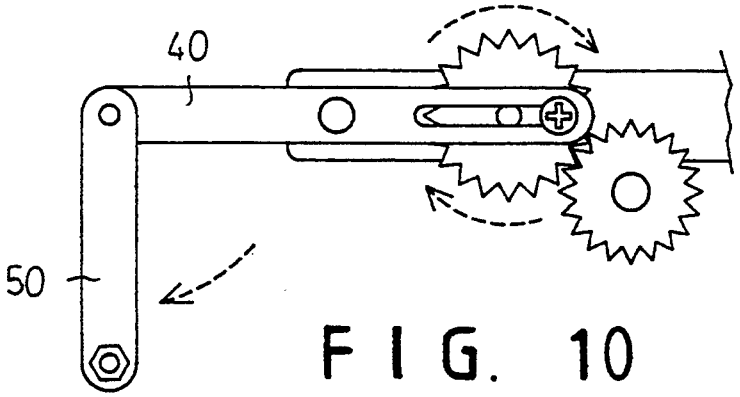
Figure 11:
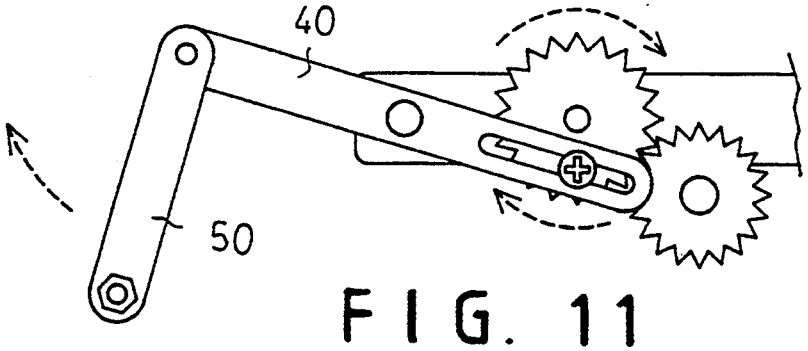

Referring now to the drawings and in particular to FIGS. 1, 2 and 3 thereof, the music box according to the present invention mainly comprises a base 1, a seat 2, a frame 3, an arm 4, a fixing member 5, a first gear 6, a supporter 7, a second gear 8, a third gear 9, a first axle 10, a second axle 20, a third axle 30, a rack 40, a lever 50, a disc 60, a screw 70, a first doll 80, a second doll 90, and a third doll 100.

As illustrated, the seat 2 is fixedly mounted on the base 1 by screws (not shown). On the seat 2 is mounted a casing 21 in which is fitted a spiral spring (not shown).

The spiral spring is connected with a control lever 25 by means of which the spiral spring can be turned tight. The spiral spring is connected with a gear train (not shown) so that the spiral spring will drive the gear train to rotate. The Gear train is in turn engaged with a driving gear 221 which is fixedly mounted on one end of a drum 22 10 formed with a plurality of protuberances 222 thereon. A hitting member 23 having a plurality of tines 231 is fixedly mounted on the seat 2, with its tines 231 contacting the surface of the drum 22.

The frame 3 is fixedly mounted on the hitting member 23 at one end. The first gear 6 is disposed under the frame 3 and meshed with the driving gear 221. The fixing member 5 is arranged on the frame 3. The first axle 10 extends downward and vertically through the fixing member 5 and the frame 3 to engage with a first gear 6 which is meshed with the gear 221 fixedly mounted on one end of the drum 22. The second gear 8 is fixedly mounted on the upper end of the first axle 10. The third gear 9 is engaged with the second gear 8 and arranged on the fixing member 5. The supporter 7 is fixedly mounted on the fixing member 5. The second axle 20 extends downward and vertically through the supporter 7 to engage with the third gear 9. A shaft 28 is connected with the driving gear 221 so that the shaft 28 will be rotated therewith. The disc 60 is rotatably connected with the shaft 28 and is formed with a hole 62 near its circumference. The arm 4 is pivotally connected with an end of the fixing member 5 and has a forked end 41 at the lower portion. The forked end 41 of the arm 4 is movably connected with the disc 8 by a pin 61 engaged with the hole 62 of the disc 60. The third axle 30 is vertically mounted on the fixing member 5. The rack 40 is pivotally mounted on the fixing member 5 at the intermediate portion and has a slot 401 at one end. The slot 401 of the rack 40 is slidably connected with the second gear 8 by a screw 402. One end of the lever 50 is fixedly connected with the other end of the rack 40. A rod 70 is connected with the other end of the lever 50.

The first doll 80 is mounted on the upper end of the arm 4, the second doll 90 on the upper end of the second axle 20, and the third doll 100 on the upper end of the rod 70.

FIGS. 4, 5, 6 and 7 show the way how the first doll is swayed backwards and forwards, and FIG. 8, 9, 10 and 11 show the way how the third doll is moved backwards and forwards.

When desired to produce music, simply turn the control lever 25 to turn the spiral spring tight and then release the control lever 25. Then, the spiral spring will drive the gear train which will in turn drive the gear 221 thereby rotating the drum 22. As the drum 22 is rotated, the tines 231 of the hitting member 23 will hit the gear train which will in turn drive the gear 221 thereby rotating the drum 22. As the drum 22 is rotated, the tines 231 of the hitting member 23 will hit the protuberances 222 of the drum 22 hence producing music. In the meantime, the gear 221 will rotate the first gear 6 which will in turn rotate the first axle 10, thereby rotating the second gear 8. When the second gear 8 is turned, the third gear 9 will be rotated thus rotating the second axle 20 and therefore rotating the doll 90. Meanwhile, the shaft 28 will rotate the disc 60 which will in turn swaying the arm 4 hence swaying the doll 80 backwards and forwards. Further, the rack 40 will be pulled by the second gear 8 which will in turn move the lever 50 thus moving the doll 100 backwards and forwards.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A music box comprising:

a base;

a seat having a casing, said seat fixedly mounted on said base;

a spiral spring fitted within said casing;

a control lever connected to said spiral spring;

a drum having a first end and a second end, said drum including a plurality of protuberances thereon;

a driving gear fixedly mounted the first end of said drum;

a gear train connected to said spiral spring and engaging said gear;

a hitting member fixedly mounted on said seat and having a plurality of tines in contact with said drum;

a frame fixedly mounted on said hitting member at one end;

a first gear disposed under said frame and meshed with said driving gear;

a fixing member arranged on said frame;

a first axle extends downward and vertically through said fixing member and said frame to engage with said first gear;

a second gear fixedly mounted on an upper end of said first axle;

a third gear engaged with said second gear and arranged on said fixing member;

a supporter fixedly mounted on said fixing member;

a second axle extending downward and vertically through said supporter to engage with said third gear;

a shaft connected with said driving gear;

a disc rotatably connected with said shaft and formed with a hole near a circumference thereof;

an arm pivotally connected with an end of said fixing member and having a forked end at a lower portion, said forked end being movably connected with said disc by a pin engaged with the hole of said disc;

a third axle pivotally mounted on said fixing member;

a rack pivotally mounted on said fixing member at an intermediate portion and having a slot at one end, said slot being slidably connected with said second gear by a screw;

a lever having an end fixedly connected with another end of said rack and another end connected with a rod;

a first doll mounted on an upper end of said arm;

a second doll mounted on an upper end of said second axle; and a third doll mounted on an upper end of said rod.

* * * * *